US005582490A

United States Patent [19]

Murray

[11] Patent Number: 5,582,490

[45] Date of Patent: Dec. 10, 1996

[54] RUMBLE STRIP CUTTER WHEEL

[75] Inventor: Stuart W. Murray, Brentwood, Tenn.

[73] Assignee: Wirtgen America, Inc., Nashville, Tenn.

[21] Appl. No.: 310,638

[22] Filed: Sep. 22, 1994

[51] Int. Cl.[6] ..... E01C 23/00

[52] U.S. Cl. ..... 404/90; 404/94

[58] Field of Search ..... 404/90, 94

[56] References Cited

U.S. PATENT DOCUMENTS

| | | | |
|---|---|---|---|
| 4,797,025 | 1/1989 | Kennedy | 404/90 |
| 5,297,894 | 3/1994 | Yenick | 404/94 X |
| 5,391,017 | 2/1995 | Thomas et al. | 404/90 |

*Primary Examiner*—William P. Neuder
*Attorney, Agent, or Firm*—Waddey & Patterson; I. C. Waddey, Jr.

[57] ABSTRACT

A multi-sided wheel to replace one of the wheels of an existing cold milling machine. The wheel has a series of flat surfaces in spaced relationship. The flat surfaces allow the machine to drop its cutting drum relative to the surface over which the machine is traveling to cut a rumble strip. As the wheel rotates, it will support the machine on one of the points formed by the confluence of two adjacent flat surfaces, thereby raising the machine and causing it to raise its cutting drum out of the rumble strip that it has just cut. Because the flat surfaces are spaced apart, the cutting drum will be moved forward in a looping fashion as the wheel rotates before the wheel drops onto the next flat surface to lower the cutting drum for cutting the next, spaced rumble strip. Thus, the multi-sided wheel causes the machine to move up and down as it propels along its path of travel. A pentagonal wheel is the optimal design for use in conjunction with a Wirtgen® W500™ cold milling machine in order to cut rumble strips meeting the specifications of the New York Thruway Authority.

21 Claims, 3 Drawing Sheets

RUMBLE STRIP CUTTER WHEEL

BACKGROUND OF THE INVENTION

The present invention relates generally to milling machines and more particularly to an improvement to cold milling machines design for cutting asphalt, concrete and other road surface materials. My improvement to such machines causes them to make cuts that are intermittent and spaced, enabling them to form "rumble strips" along the shoulders of highways.

It will be appreciated by those skilled in the art that cold milling machines have existed for many years. Such machines have specially designed milling drums with righted sections protruding in a spiral pattern radially outwardly from the drum. Cutting tool holders are mounted generally on the righted section and cutting tools are fitted within the cutting tool holders. These machines are designed to travel along a road, highway or other thoroughfare and make a continuous cut (up to 6 feet in width and 12 inches in depth) of the pavement over which they pass. Machines of this type generally fall in the category of road building or material handling equipment.

Known cold milling machines cut the top layer of the road surface material, chop the material into granular form, and rake the material onto a conveyor so that it can be removed from the site. The road can then be paved with new material, keeping the road surface at the desired height and weight.

My invention is directed to a modification of known cold milling machines which will enable the machines to cut, in the shoulders of existing highways, a safety feature known generally as "rumble" strips and to perform this task at increased efficiency and reduced costs.

Rumble strips are a variation of features used to control speed in private parking lots and the like referred to as "speed bumps". The precursor to rumble strips was the use of fluted ridges, creating a washboard effect, on highways and traffic passageways, particularly during the construction phase of the nationwide interstate highway system in this country. Because the interstate highways were built in sections, it was frequently required for travelers to exit the section of completed highway onto local roads and travel local roads for a period of time until reaching the next section of completed interstate highway. Motorists would often fail to recognize the termination point of a complete section of an interstate highway because of the uniform appearance of the newly constructed interstate highway system, and because travelling motorists were not familiar with the interstate highway system. Missing the required exit often would result in accidents because of the high speed of travel over unfinished interstate sections.

In order to alert motorists to the fact that they were approaching a required exit, a series of fluted ridges were placed across the highway, spanning the highway and running perpendicular to the direction of traffic flow. When an automobile travelling at a high rate of speed passed over the fluted ridges, the tires would create a roaring sound, startling the driver and causing him to be more alert to his surroundings. By startling the driver and causing him to become more alert, he would notice the signage that provided instructions regarding exiting the segment of completed interstate highway, thus preventing accidents as a result of missed exits and crashes at a high rate of speed into an unfinished portion of the interstate.

SUMMARY OF THE INVENTION

Since the completion of interstate highway system in this Country, experts have come to realize that the uniformity of the interstate highway system can be almost hypnotic, causing the driver of an automobile to become less attentive to his driving. Further, people tend to drive for longer periods of time and late at night causing drowsiness and the tendency to dose off at the wheel.

If the driver is not alert, either because he is in trance by the monotony of the interstate highway or is travelling late at night and gets sleepy, a very dangerous situation exists. Since the automobile is usually travelling at a high rate of speed, if the driver is sleepy and doses at the wheel, the automobile could easily run off of the road, crash and cause serious injury to the driver, other drivers in the area, and the destruction of their automobiles and other property.

If a driver begins to run off of the road because he has dosed or fallen asleep, it has been learned that he can be awakened, alerted or otherwise startled in sufficient time generally to recover and bring his vehicle back into the proper travel lane if a series of ruts are formed in the shoulder of the highway immediately adjacent the travel lane. Ruts are preferable to ridges because they do not wear down with time, they do not require extra material, and they do not interfere with snow plow operations and the like.

When constructing new highways, the ruts, generally known as rumble strips, can be formed in the shoulders of the highway and provide this safety feature as a part of the new construction. Unfortunately, most of the interstate highway system was developed prior to the discovery of the benefits of rumble strips in the shoulders of highways and the tremendous savings, measured in terms of lives saved and property damage avoided, that could be achieved by the provision of such a feature as an adjunct to highway design. Thus, it has become necessary, in order to provide rumble strips adjacent preexisting highways, to cut rumble strips into existing road shoulders.

Heretofore, in order to form rumble strips in the shoulders of preexisting roads, it was necessary to align the cold milling machine for travel along the shoulder of the road, drop the cutter to cut a rumble strip, raise the cutter, move the cutter forward approximately 12 inches, stop the machine, drop the cutter to cut another rumble strip, raise the cutter, move the machine forward another 12 inches, stop the machine, drop the cutter to cut another rumble strip and repeat the process for the full length of the shoulder of the road. This process is a time consuming one and has caused the cost of adding the safety feature of rumble strips along the shoulders of existing highways to be a major limitation on the ability to provide this feature on all existing interstate highway systems and similar turnpikes and parkways.

Considering the deficiencies in the existing method of and equipment for cutting rumble strips into shoulders of preexisting roadways, Applicant has undertaken to develop a machine that would cut rumble strips in a fast and efficient manner at a greatly reduced cost. Applicant's invention is the development of a multi-sided wheel to replace one of the wheels of an existing cold milling machine. The multi-sided wheel causes the machine to move up and down as it propels along its path of travel. Applicant has found a pentagonal wheel to be the optimal design for use in conjunction with a Wirtgen® W500™ cold milling machine of the type described in the brochure appended hereto as a bibliographical reference. Wirtgen America, Inc., the assignee of Applicant's patent application, is the manufacture of the Wirtgen® W500™ machine, but the pentagonal wheel of Applicant's invention can be used in conjunction with a variety of other cold milling machines, either three wheel or four wheel machines with the pentagonal wheel placed adjacent to the cutting drum of the machine.

Considering the deficiencies of the prior art, it is an object of the present invention to provide a modification to an existing cold milling machines that will allow them to quickly, efficiently and at a substantially reduced expense cut rumble strips in the shoulders of existing highways.

It is a further object of the present invention to provide a rumble strip cutting machine that causes the cutting drum of the machine to move in an up and down motion as the machine moves along its travel path.

It is a further object of the present invention to provide a modification to existing cold milling machines that will allow the construction of rumble strips in the course of continuous movement of the cold milling machine along a pathway.

It is a further object of the present invention to provide a cold milling machine that will cut rumble strips in the shoulders of existing highways with the rumble strips being spaced from each other and with the machine cutting the strips as it moves continuously along its path of travel.

Having stated some of the primary objects of the present invention, this invention will be understood more clearly when consideration is given to the description of the preferred embodiment made in conjunction with the accompanying drawings.

shows a plain view of a portion of the highway, and the location, detail and pattern of a particular rumble strip.

Figure 3:
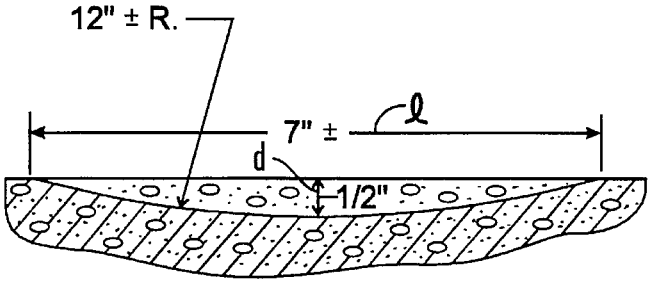

FIG. 3 is a cross sectional view of the highway showing the profile of a specified rumble strip.

Figure 4:
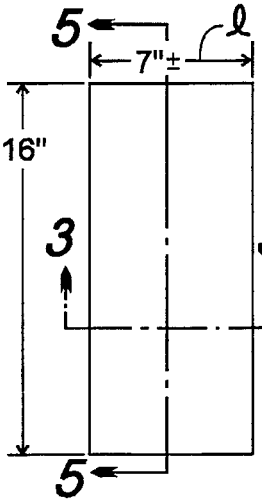

FIG. 4 shows a plain view of the rumble strip.

Figure 5:
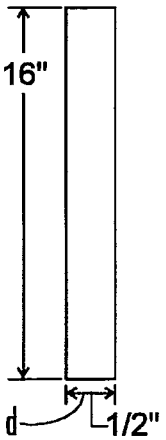

FIG. 5 shows a view of the rumble strip along section BB of FIG. 4.

Figure 6:
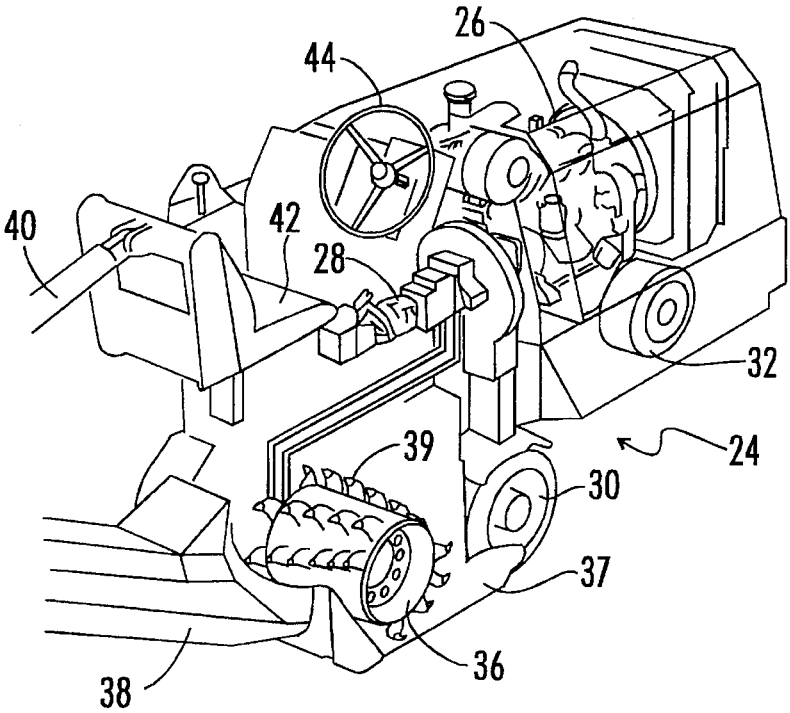

FIG. 6 shows a cold milling machine of the type which my invention is designed to modify.

Figure 7:
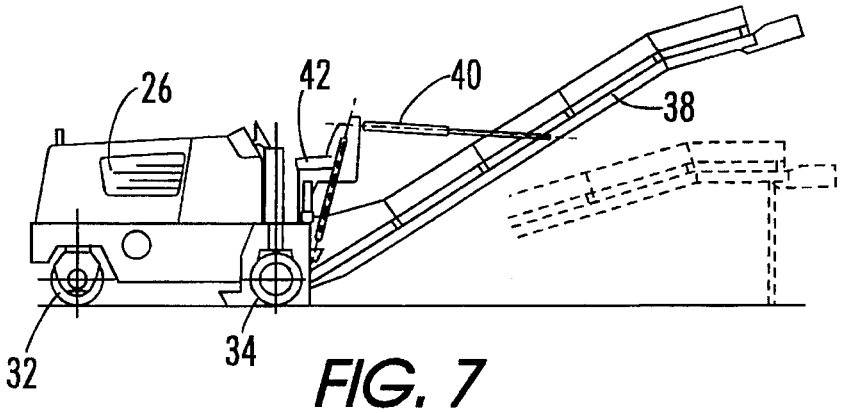

FIG. 7 shows a side elevation in schematic of the cold milling machine shown in FIG. 6.

Figure 8:
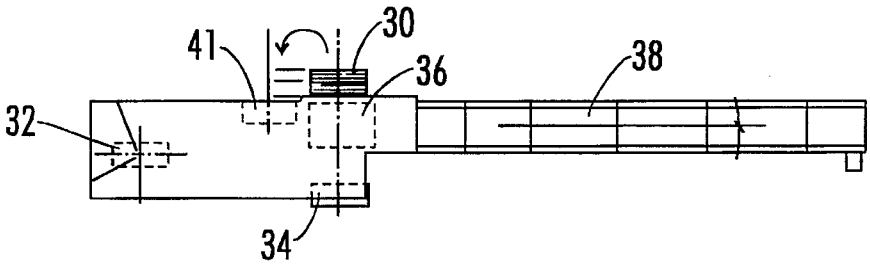

FIG. 8 is a top view in schematic of the cold milling machine shown in FIG. 7.

Figure 9:
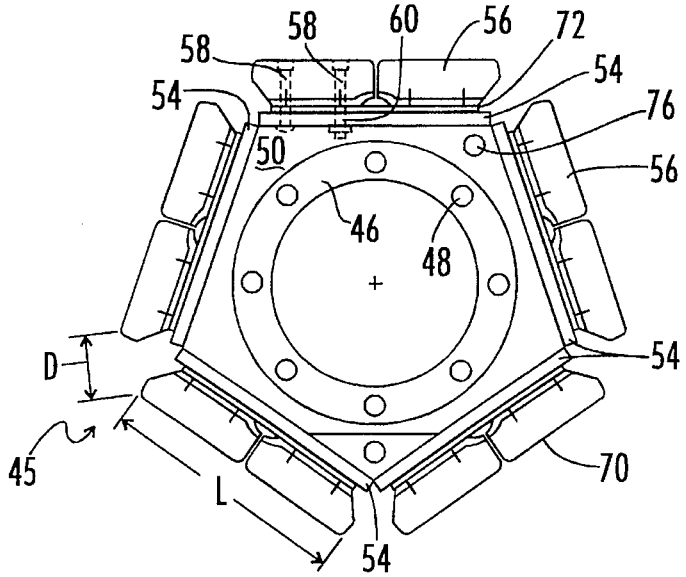

FIG. 9 is a side view of the pentagonal wheel of my invention.

Figure 10:
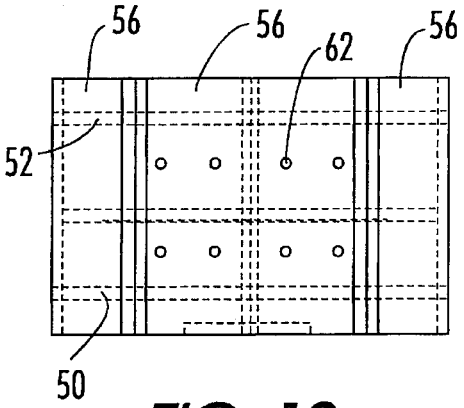

FIG. 10 is a top view of the pentagonal wheel of my invention.

Figure 11:
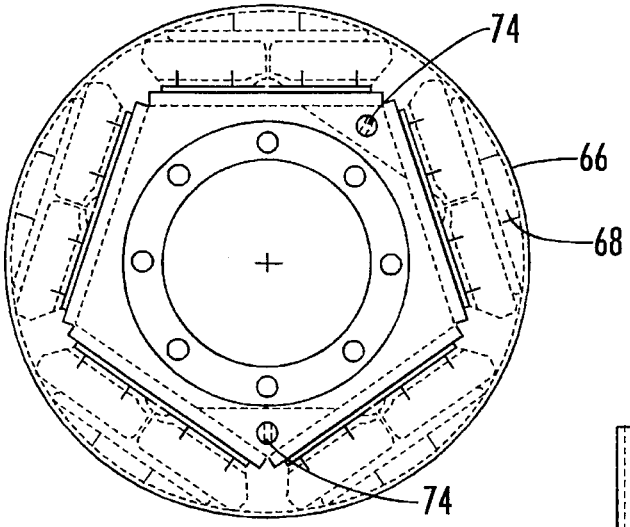

FIG. 11 is a side view of my invention with a transport sleeve mounted thereon.

Figure 12:
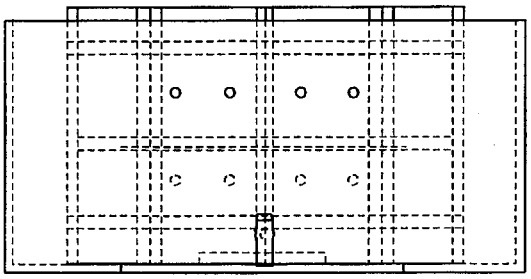

FIG. 12 is a top view of my invention with the sleeve in place.

DESCRIPTION OF THE PREFERRED EMBODIMENT

Figure 1:
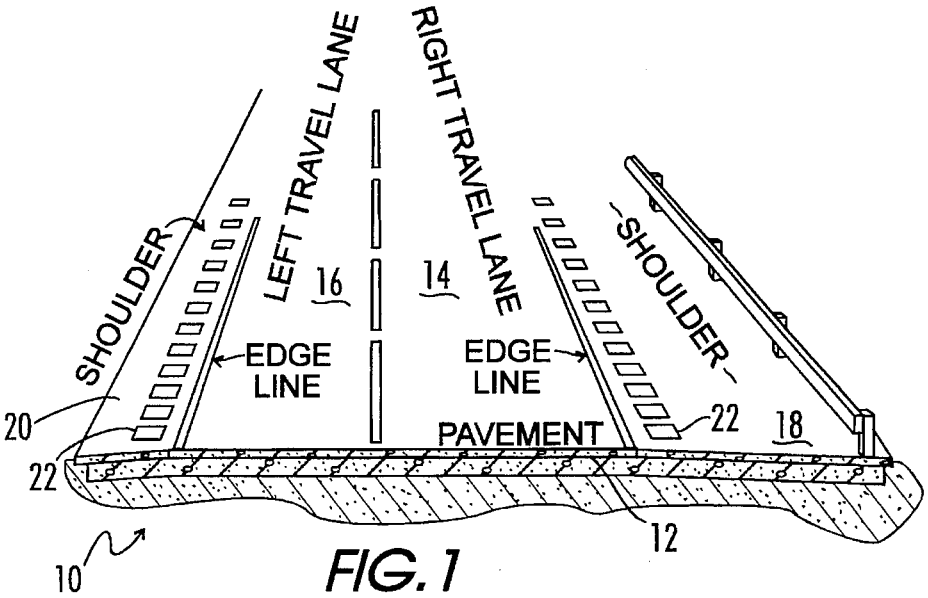
FIG. 1 shows a perspective view of a highway with left and right travel lanes, and left and right shoulders, and rumble strips cut in the shoulders.
Figure 2:
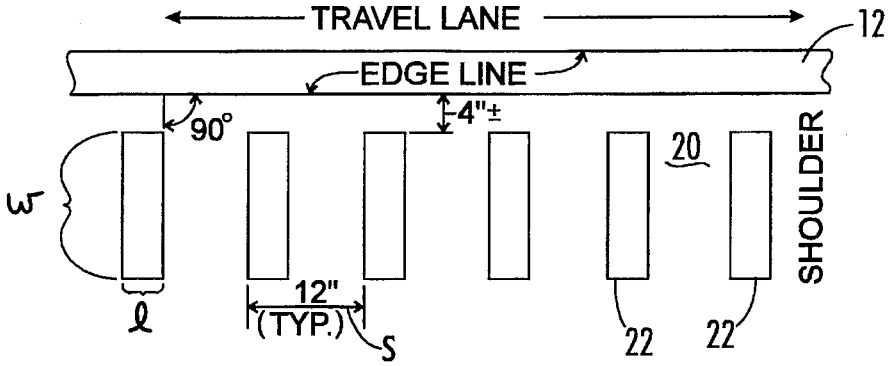

FIGS. 1–5 are illustrations adapted from the specification of the New York State Thruway Authority in its request for bid for the construction of rumble strips in an existing New York State Thruway. FIG. 1 shows a perspective view of a highway with a cross sectional view of the highway in the foreground. The highway 10 includes pavement 12 forming a right traffic lane 14 and a left traffic lane 16. To the right of the right traffic lane 14 is the right shoulder and to the left of the left traffic lane 16 is the left shoulder 20. Rumble strips 22 are shown formed in the shoulders 18, 20 of the highway 10. The rumble strips 22 could be pre-formed in the highway as it is originally constructed or, for the purposes of considering Applicant's invention, cut into the shoulders at some time after the shoulders are formed adjacent the highways and constructed with a smooth upper surface.

Referring now to FIGS. 2–5, the details of the rumble strips 22 are shown. The rumble strips 22 include a width w, a length l and a depth d. Each rumble strip is spaced from the adjacent rumble strips, a spaced distance s measured from leading edge to leading edge of adjacent rumble strips. The space between the trailing edge of one rumble strip and the leading edge of the next rumble strip is a flat surface. The rumble strips as specified by the New York State Thruway Authority are a spaced distance s of 12", the rumble strips themselves have a length l of 7" and a depth d of ½. Rumble strips are spaced from the edge of the travel lane a distance of approximately 4" and have a width of approximately 16".

Rumble strips having the shape as specified by the New York State Thruway Authority and as set forth herein have been established to be most effective in creating a loud noise and vibration to the automobile when an automobile travelling at a high rate of speed leaves the travel lane and passes onto a shoulder in which a rumble strip of this design has been incorporated. The bumping of the tires of an automobile into the ½ " depth of the rumble strip is sufficient to create a loud noise and startle the driver, but the modest depth of the rumble strip will not generally cause the wheel of the vehicle to react and throw the automobile off its line of travel. Further, by having the flat surface of the shoulder between the spaced rumble strips, there is sufficient surface for the driver to regain control of the automobile and pull it back into the appropriate travel lane and the rumble strips do not interfere with that corrective action.

While the rumble strips as described are most efficient in creating a loud noise by the wheel of a vehicle passing over them at a high rate of speed and by vibrating the automobile to alert and startle the driver to the impending danger, the rumble strips themselves are difficult to cut into the shoulder of the road as a post constructive feature. If the rumble strips are formed in the road when it is being built, that can be done by providing a series of protrusion on the roller of the roller machine as it compresses the hot asphalt. However, once the asphalt is set, passing a roller with protrusions on it over the shoulder will have no effect on the profile on the shoulder. Thus, the rumble strips have to be cut, and once the material has set, the cutting process is one of substantial difficulty. Further, cutting the strips in the pattern as specified by the New York State Highway Authority and similar highway management organizations of the various states and the Federal Highway System is most difficult.

Applicant's invention, which can be used to cut the rumble strips illustrated schematically in FIGS. 1–5, will be best understood when consideration is given to FIGS. 6–12.

Referring first to FIG. 6, there is shown a Wirtgen® W500™0 three-wheel cold milling 24 includes an engine 26 and a drive train 28 through which power is transferred to power the wheels of the machine in a rotating motion to cause the machine to move along a path of travel. The engine 26 also provides power, through well known drive train mechanism, for rotating the cutter drum of the cold milling machine 24.

The machine 24 as illustrated is of a three-wheel design, but may be or a four-wheel design, including one or two front wheels 32, a rear wheel 34 and a displacement wheel 30. The front wheel 32 is guided by the action of a known steering system to which is connected the steering wheel 44.

The cold milling machine 24, depending upon the size of the machine, may have one or all of the wheels 30, 32 and 34 driven through the power train 28 receiving its power from engine 26.

Shown at 36 is the cutter drum which is positioned within the housing 37 of the milling machine 24. The cutting drum 36 has teeth 39 mounted about the outside perimeter thereof. The cutting drum 36 is rotated about its axis and the teeth 39 engage the face of the asphalt over which the machine 24 is travelling to mill the face of the asphalt at a desired width and depth. As the cutter drum 36 rotates, the teeth 39 also tend to chop the material which is cut from the surface of the asphalt or concrete roadway. The granulated material is then raked toward the center of the drum and ultimately into the conveyer 38. The conveyer 38 can be any of several known systems of belt and roller construction with paddles across the face of the belt to convey the granulated material up the conveyer to be dumped into a truck which is trailing along behind the machine 24. In this manner, the waste material can be removed from the cite and disposed of while allowing the road surface to be cleaned for further treatment.

As can also be seen from FIGS. 6–8, the machine 24 has a known hydraulic mechanism 40 for raising and lowering the conveyer 38 and a seat 42 for the operator of the machine.

FIG. 8 illustrates the two position capacity of the displacement wheel 30. As is shown in FIG. 8, the displacement wheel 30 is outside the machine 24 and axially aligned with and adjacent to the cutter drum 36. However, the displacement wheel 30 can be rotated about a pivot connection into the wheel well 41 (see FIG. 8) which is the position of the displacement wheel 30 as illustrated in FIG. 6.

The displacement wheel 30 is mounted to a hydraulic lifter mechanism of known construction attached to the machine 24 so that the displacement wheel 30 can be raised and lowered in order to lower and raise the position of the cutter drum 36 in relationship to the pavement over which the machine is travelling, thereby varying the depth of the cut of the cutter drum 36 into the pavement. Further, the displacement wheel 30 can be raised to a point where it clears the surface on which the machine is sitting, the machine being supported in its right rear quadrant (as viewed by the operator sitting in seat 42) by resting on the cutter drum 36. When the displacement wheel 30 is raised to clear the surface on which the machine is sitting, it then can be moved between the two positions, either adjacent the cutter drum as shown in FIG. 8, or inside the wheel well 41 as is shown in FIG. 6.

Since the displacement wheel 30 is able to move up and down relative to the machine 24, in adapting this machine to cut rumble strips, one might consider creating a timing mechanism for causing the displacement wheel 30 to move up and down relative to the machine 24 on a hydraulically controlled timing system. However, the mechanics of such a system would wear out rapidly and the design of such a system would have to be too sophisticated for heavy road working machinery and would likely be subject to frequent failure and expensive repair. Applicant's approach to the problem is much simpler, adopting the idea of causing the machine 24 to raise and lower itself as it moves along a path of travel, but creating the up and down movement by replacing the displacement wheel 30 with a piston wheel 45.

Applicant's improvement is described as a piston wheel because of its non-circular shape as can be seen from FIG. 9. The non-circular shape of the piston wheel 45 causes the milling machine 24 to move in a piston-like, up and down movement as the machine 24 moves along its path of travel. Applicant's piston wheel 45 can be of a variety of cross sectional shapes, the controlling factor is that the cross sectional shape is not circular. When the piston wheel 45 is of any cross sectional shape other than circular, it will cause some up and down movement of machine 24 as the piston wheel 45 rotates during the course of travel of the machine 24 along its predetermined path.

In the preferred embodiment of Applicant's invention, the piston wheel 45 is pentagonal, as can be seen from FIG. 9. The piston wheel 45 has a hub 46 which is essentially the same shape and design as the hub of the displacement wheel 30 so that the piston wheel 45 can be placed directly onto the lugs of the axle of a machine when the displacement wheel 30 is removed. The piston wheel 45 includes lug bolt holes 48. The lug bolt holes are in registry with the lugs of the axle of the machine so that the piston wheel 45 can be mounted directly onto the hub of the machine 24.

The piston wheel 45 includes a front plate 50 and a rear plate 52, each welded or otherwise rigidly and fixedly attached to the hub 46. Face plates 54 are spaced about the perimeter of the piston wheel 45 and fixedly attached to the front plate 50 and rear plate 52 to create a paddle wheel appearance to the piston wheel.

Attached to the face plates 54 are polyethylene pads 56. The polyethylene pads 56 have holes 58 passing through them and in registry with elongated holes 60 in face plates 54. Bolts 62 pass through the holes 58 and pass through the elongated holes 60 and are connected by bolts on the back side of the face plates 54 to securely attach the polyethylene pads 56 to the face plates 54. The purpose of the polyethylene pads is to facilitate repair of the piston wheel 45. If pads were not provided, the face plates would wear and bend and would have to be replaced with significant downtime and manpower expense. By providing the face plates with the polyethylene pads, as the polyethylene pads wear, they can be removed by loosening the bolts 62 and replaced with other fresh full profile pads in order to assure that the rumble strips are cut in the desired shape. In the preferred embodiment, the pads 56 are constructed in parts, preferably each pad is two-pieced, so that they may be spread or narrowed to change the gap between the pads and to thereby change the distance of the apex of the angle between adjacent pads from the axis of the piston wheel 45 to enable the operator to easily adjust the lift of the machine 26 as it responds to the rotation of the piston wheel 45. To accomplish this adjustment of the two-pieced pads, the holes 60 are slotted, having the length of the slots running substantially parallel to the front to back length of the machine 26.

As can be seen on both FIGS. 9 and 11, spacer plates 72 are provided on the outside of the face plates 54. These spacer plates 72 serve the function of a shim and are removeable so that one set of spacer plates can be substituted for another, the different sets of spacer plates functioning to enable the diameter of the piston wheel 45 to be easily changed.

FIGS. 11 and 12 illustrate the rim 66 which is provided as part of Applicant's invention. The rim 66 fits over the polyethylene pads 56 and blocks 68 are formed on or attached to the inside the rim 66 to brace the rim against the polyethylene pads 56 and hold it in position and keep it from deforming. The rim 66 is provided to allow the machine 24 to be conveniently moved from one location to another or loaded onto a transport vehicle without having to remove the piston wheel 45 and replace it with the displacement wheel 30. To secure the rim 66 in place and keep it from working its way off of the wheel 45 during transportation of the machine, rim 66 has an outside ting which hides the piston wheel 45 from view when the rim is mounted on the wheel and studs 74 project toward the center of the machine and are in registry with holes 76 in the hub of the wheel. The studs 74 pass through the holes 76 and are attached to the backside of the wheel by a bolt, carter pin or the like removeably affixed to the end of the stud.

In operation, when displacement wheel 30 is removed and replaced by the piston wheel 45, the machine 24 will have an up and down motion as it travels along its intended path. The up and down motion of the machine will cause the cutter drum 38 to be raised and lowered as the machine moves along its path of travel thereby cutting rumble strips of the specified shape and size. Because of the pentagonal shape of the piston wheel 45, the machine will raise the cutter drum 36 out of a rumble strip, move the machine forward a sufficient distance so that once the machine drops down to sit on the flat portion 70 of the polyethylene pad, the cutter drum 36 will make a cut and form another rumble strip. The piston wheel 45 will continue to rotate and start to lift the cutter drum 36 out of the recently cut rumble strip and move the whole system forward sufficient distance to space the following rumble strip the desired distance from the preceding rumble strip. Thus, the motion of the machine is not only up and down but has the motion of a non-uniform sine wave.

It is important that the series of flat surfaces 70 of the pads 56 be in a spaced relationship. The flat surfaces 70 allow the machine to drop its cutting drum 36 relative to the surface over which the machine is traveling to cut a rumble strip. As the wheel 45 rotates, it will support the machine on one of the points formed by the confluence of two adjacent flat surfaces, thereby raising the machine 24 and causing it to raise its cutting drum 36 out of the rumble strip that it has just cut. Because the flat surfaces 70 are spaced apart, when the machine is supported on the point of confluence of the adjacent surfaces, there is a distance of movement forward of the machine 24 that takes place before the machine 24 starts to drop again to cut another strip. Thus, the cutting drum 36 will be moved forward in a looping fashion as the wheel 45 rotates before the wheel drops onto the next flat surface 70 to lower the cutting drum for cutting the next, spaced rumble strip.

The dimensions of Applicant's piston wheel 45 in this particular embodiment and adapted for use with the Wirtgen® W500™ machine and which will, when used in the manner described, form rumble strips in accordance with New York Thruway Authority and Federal Department of Transportation specification are as follows: the length L of the polyethylene pads is 9.5"; the distance D from the tip of one polyethylene pad to the other is 2"; and the length of a line passing through the axis of the piston wheel 45 and perpendicular to the surface 70 of a polyethylene pad 56 from the surface 70 to a point at the maximum outer perimeter of the piston wheel 45 as defined by a line drawn between the tips of the opposing polyethylene pads 56 is 18.5".

Although there have been described particular embodiments of the present invention of a new and useful Rumble Strip Cutter Wheel, it is not intended that such references be construed as limitations upon the scope of this invention except as set forth in the following claims. Further, although there have been described certain dimensions used in the preferred embodiment, it is not intended that such dimensions be construed as limitations upon the scope of this invention except as set forth in the following claims.

What I claim is:

1. An improvement to a cold milling machine, such machine including at least three wheels which serve to support the machine on a road-type surface during its operation, means mounting each wheel on said machine and for rotation about an axis, means for advancing the machine via said wheels along a given path over said surface, a milling drum rotatably mounted on the machine for cutting a width of material from said surface as said milling drum rotates, and means for rotating said milling drum, the improvement including a piston wheel, said piston wheel being mounted to said machine for rotation about an axis, said piston wheel having an outer perimeter spaced radially outwardly from its axis, said outer perimeter being non-circular, said outer perimeter of said piston wheel being in constant contact with said road-type surface during operation of said machine whereby an up and down motion is imparted to said machine by said piston wheel as the machine is advanced along said given path over said surface to cause said milling drum to be lowered and raised relative to said surface to thereby make intermittent cuts in said surface.

2. The device of claim 1 wherein the outer perimeter of said piston wheel is pentagonal.

3. The device of claim 1 further including wear pads mounted on said outer perimeter.

4. The device of claim 3 including means for removably mounting said wear pads on said outer perimeter whereby said pads may be removed from said outer perimeter after wear and replaced with new pads.

5. The device of claim 1 wherein said outer perimeter has a shape selected from the group consisting of rectangular, square, triangular, pentagonal, and hexagonal.

6. The device of claim 1 wherein said outer perimeter is formed by multiple face plates.

7. The device of claim 6 wherein wear pads are attached to said face plates.

8. The device of claim 7 including means for removably mounting said wear pads to said face plates whereby said pads may be removed from said face plates after wear and replaced with new pads.

9. The device of claim 7 wherein gaps are between adjacent pads.

10. The device of claim 7 further including sections between adjacent pads that must be bridged by said surface as said piston wheel passes over said surface.

11. The device of claim 6 wherein said face plates have a flat surface which form a part of the said outer perimeter of said piston wheel.

12. The device of claim 1 wherein said piston wheel is shaped so that it will impart a motion to the milling machine that will cause the milling drum to cut rumble strips in the surface in substantially the pattern and shape shown in FIGS. 1–5 hereof.

13. The device of claim 7 wherein said pads are of two-pieced construction and further including means whereby the pads can be widened and narrowed.

14. The device of claim 7 further including space plates and means removably mounting said space plates to said wheel whereby the diameter of the wheel can be adjusted by replacing one size space plate with a different size space plate.

15. The device of claim 1 further including a rim removably mounted to said wheel which can be mounted over said wheel to facilitate transportation of said machine from one job site to another.

16. In combination, a cold milling machine having an engine to provide power to the machine, means for propelling the machine over a road-type surface, a milling drum for milling the surface over which the machine passes, wheels on which the machine is mounted and which roll over the surface for transporting the machine over the surface, at least one of the wheels having a non-circular shape that imparts to the machine an up and down motion as the wheel rolls over the surface during the course of operation of the machine, said at least one wheel causing the machine to raise and lower said milling drum as the machine moves along its path of travel whereby rumble strips are cut in the surface.

17. A wheel for mounting on a cold milling machine to directly impart an up and down motion to the machine on which it is mounted, said wheel having a hub, means for attaching said wheel to said machine, an outer perimeter designed to roll along the surface over which the machine is propelled at least one plate projecting radially outwardly from said hub and face plates connected to said at least one radially projecting plate, said face plates having outer surfaces, said outer surfaces being substantially flat, and said outer surfaces forming the outer perimeter of said wheel.

18. The device of claim 17 wherein there are pads removably connected to said face plates.

19. The device of claim 18 wherein said pads are constructed from a wear resistant polyethylene material.

20. The device of claim 18 wherein adjacent pads are spaced from each other.

21. The device of claim 18 there are gaps between adjacent pads.

* * * * *